US010086241B2

(12) United States Patent
Mizutani

(10) Patent No.: US 10,086,241 B2
(45) Date of Patent: Oct. 2, 2018

(54) HOLLOW GOLF CLUB HEAD

(71) Applicant: SUMITOMO RUBBER INDUSTRIES, LTD., Kobe-shi, Hyogo (JP)

(72) Inventor: Naruhiro Mizutani, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/629,363

(22) Filed: Jun. 21, 2017

(65) Prior Publication Data

US 2018/0001159 A1 Jan. 4, 2018

(30) Foreign Application Priority Data

Jun. 30, 2016 (JP) ..... 2016-130773

(51) Int. Cl.
*A63B 53/08* (2015.01)
*A63B 53/04* (2015.01)
*A63B 60/52* (2015.01)

(52) U.S. Cl.
CPC ..... *A63B 53/0466* (2013.01); *A63B 60/52* (2015.10); *A63B 53/08* (2013.01); *A63B 2053/0408* (2013.01); *A63B 2053/0433* (2013.01); *A63B 2053/0491* (2013.01)

(58) Field of Classification Search
CPC .... A63B 2053/0433; A63B 2053/0408; A63B 53/0466; A63B 53/08
USPC ..... 473/345, 346, 350
See application file for complete search history.

(56) References Cited

U.S. PATENT DOCUMENTS

| | | | | |
|---|---|---|---|---|
| 8,430,763 | B2 * | 4/2013 | Beach | A63B 53/0466 473/307 |
| 8,821,312 | B2 * | 9/2014 | Burnett | A63B 53/0466 473/329 |
| 8,834,289 | B2 * | 9/2014 | de la Cruz | A63B 53/0466 473/329 |
| 9,707,457 | B2 * | 7/2017 | Mata | A63B 53/06 |
| 9,839,817 | B1 * | 12/2017 | Johnson | A63B 53/0466 |
| 9,889,346 | B2 * | 2/2018 | Boggs | A63B 53/04 |
| 2014/0342848 | A1 | 11/2014 | Burnett et al. | |
| 2015/0367205 | A1 | 12/2015 | Boggs et al. | |

* cited by examiner

*Primary Examiner* — Benjamin Layno
(74) *Attorney, Agent, or Firm* — Birch, Stewart, Kolasch & Birch, LLP

(57) ABSTRACT

A head 2 includes a face 10 and a sole 6. The face 10 has a face center Fc. The sole 6 includes a groove 20 extending from a toe side to a heel side. The whole groove 20 is located below the face center Fc. A bottom part of the groove 20 is curved so that it projects to a lower side along a shape of the sole 6. A maximum value of a groove depth D of the groove 20 is 5% or greater but 15% or less of a height of a center of gravity of the head. The head 2 is a hollow golf club head.

12 Claims, 11 Drawing Sheets

HOLLOW GOLF CLUB HEAD

The present application claims priority on Patent Application No. 2016-130773 filed in JAPAN on Jun. 30, 2016, the entire contents of which are hereby incorporated by reference.

BACKGROUND OF THE INVENTION

Field of the Invention

The present invention relates to a hollow golf club head.

Description of the Related Art

A hollow golf club head including a sole including a groove has been known. The section shape of the groove is curved so that it projects toward the inner side of the head. The groove provided in the sole contributes to an improvement in restitution performance. US2015/0367205 discloses a head including a sole including a channel. US2014/0342848 discloses a head including a groove referred to as SRF and provided on each of a toe side and a heel side.

SUMMARY OF THE INVENTION

In light of only the restitution performance due to the groove, the groove is largely extended on the toe upper side and the heel upper side. However, it has become clear that flight distance performance has been further improved by improving the disposing of the groove.

The present disclosure provides a golf club head having excellent flight distance performance.

In one aspect, a golf club head may include a face and a sole. The face may have a face center. The sole may include a groove extending from a toe side to a heel side. The whole groove may be located below the face center. A bottom part of the groove may be curved so that it projects to a lower side along a shape of the sole. A maximum value of a groove depth of the groove may be 5% or greater but 15% or less of a height of a center of gravity of the head. The head may be hollow.

In another aspect, the maximum value of the groove depth may be equal to or less than 10% of the height of the center of gravity of the head.

In another aspect, the head may satisfy the following item (x), (y), or (z):

(x) the groove depth is gradually decreased as the groove depth approaches a toe end in a toe side end part of the groove, and the groove depth becomes zero in the toe end;

(y) the groove depth is gradually decreased as the groove depth approaches a heel end in a heel side end part of the groove, and the groove depth becomes zero in the heel end;

(z) the groove depth is gradually decreased as the groove depth approaches the toe end in the toe side end part of the groove, and the groove depth becomes zero in the toe end; and the groove depth is gradually decreased as the groove depth approaches the heel end in the heel side end part of the groove, and the groove depth becomes zero in the heel end.

In another aspect, the maximum value of the groove depth may be 0.8 mm or greater but 3.2 mm or less.

In another aspect, the groove may include a center groove part and a toe groove part located on the toe side with respect to the center groove part. The groove may include a heel groove part located on the heel side with respect to the center groove part. The golf club head may satisfy the following item (a), (b), or (c):

(a) a groove depth of the center groove part is smaller than a groove depth of the toe groove part;

(b) the groove depth of the center groove part is smaller than a groove depth of the heel groove part;

(c) the groove depth of the center groove part is smaller than the groove depth of the toe groove part, and the groove depth of the center groove part is smaller than the groove depth of the heel groove part.

In another aspect, if a toe-heel direction length of the groove is defined as Lm, and a toe-heel direction maximum width of the head is defined as Lh, Lm/Lh may be 0.7 or greater but 0.92 or less.

DESCRIPTION OF THE PREFERRED EMBODIMENTS

Hereinafter, the present disclosure will be described in detail according to the preferred embodiments with appropriate references to the accompanying drawings.

Definitions of Terms

The definitions of terms in the present application are as follows.

[Reference State]

Figure 11:
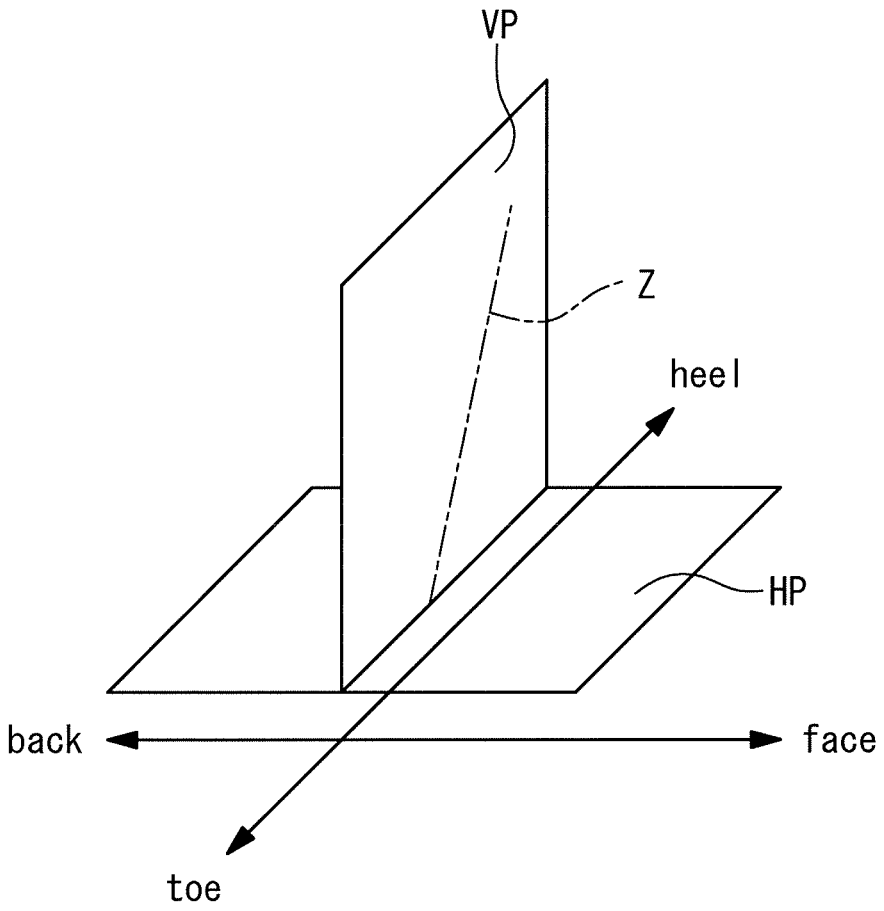
FIG. 11 is a perspective view showing a horizontal plane HP and a reference perpendicular plane VP in a reference state.

The reference state is a state where a head is placed at a predetermined lie angle and real loft angle on a horizontal plane HP. In the reference state, a center axis line Z (shaft axis line Z) of a shaft hole of the head is provided in a reference perpendicular plane VP (see FIG. 11). The reference perpendicular plane VP is a plane perpendicular to the horizontal plane HP. In the reference state, the center axis line Z is inclined at the lie angle with respect to the horizontal plane HP, and a face surface of the head is inclined at the real loft angle with respect to the reference perpendicular plane VP.

[Toe-Heel Direction]

In the head of the reference state, the direction of an intersectional line between the reference perpendicular plane VP and the horizontal plane HP is the toe-heel direction.

[Face-Back direction]

A direction perpendicular to the toe-heel direction and parallel to the horizontal plane HP is the face-back direction.

The face-back direction is also a front-rear direction. A face side is also referred to as a front side.

[Up-Down Direction]

A direction perpendicular to the toe-heel direction and perpendicular to the face-back direction is the up-down direction.

[Face Center Fc]

First, an optional point Pr approximately located near the middle of the face surface in the up-down direction and the toe-heel direction is selected. Next, a plane is determined, which passes through the point Pr, extends along the normal direction of the face surface at the point Pr, and is parallel to the toe-heel direction. An intersectional line between the plane and the face surface is drawn, and a middle point Px of the intersectional line is determined. Next, a plane is determined, which passes through the middle point Px, extends along the normal direction of the face surface at the point Px, and is parallel to the up-down direction. An intersectional line between the plane and the face surface is drawn, and a middle point Py of the intersectional line is determined. Next, a plane is determined, which passes through the middle point Py, extends along the normal direction of the face surface at the point Py, and is parallel to the toe-heel direction. An intersectional line between the plane and the face surface is drawn, and a middle point Px of the intersectional line is newly determined. Next, a plane is determined, which passes through the new middle point Px, extends along the normal direction of the face surface at the point Px, and is parallel to the up-down direction. An intersectional line between the plane and the face surface is drawn, and a middle point Py of the intersectional line is newly determined. The process is repeated to sequentially determine Px and Py. The new position Py (last position Py) when a distance between the new middle point Py and the middle point Py just before that is first equal to or less than 1 mm during the repetition of the process is the face center Fc.

[Leading Edge]

A point located on a frontmost side (face side) in the section of the head taken along the face-back direction is the leading edge.

[Bottom Plan View]

A plan view when the head is viewed from a lower side (sole side) is referred to as bottom plan view. The bottom plan view is a projection view obtained by projecting a sole surface on a plane. The direction of the projection is the up-down direction. The bottom view of the head in the present application corresponds to the bottom plan view.

[Height of Center of Gravity of Head]

In the reference state, a distance between the horizontal plane HP and the point of the center of gravity of the head is the height of the center of gravity of the head. The height is measured along the up-down direction.

Figure 1:
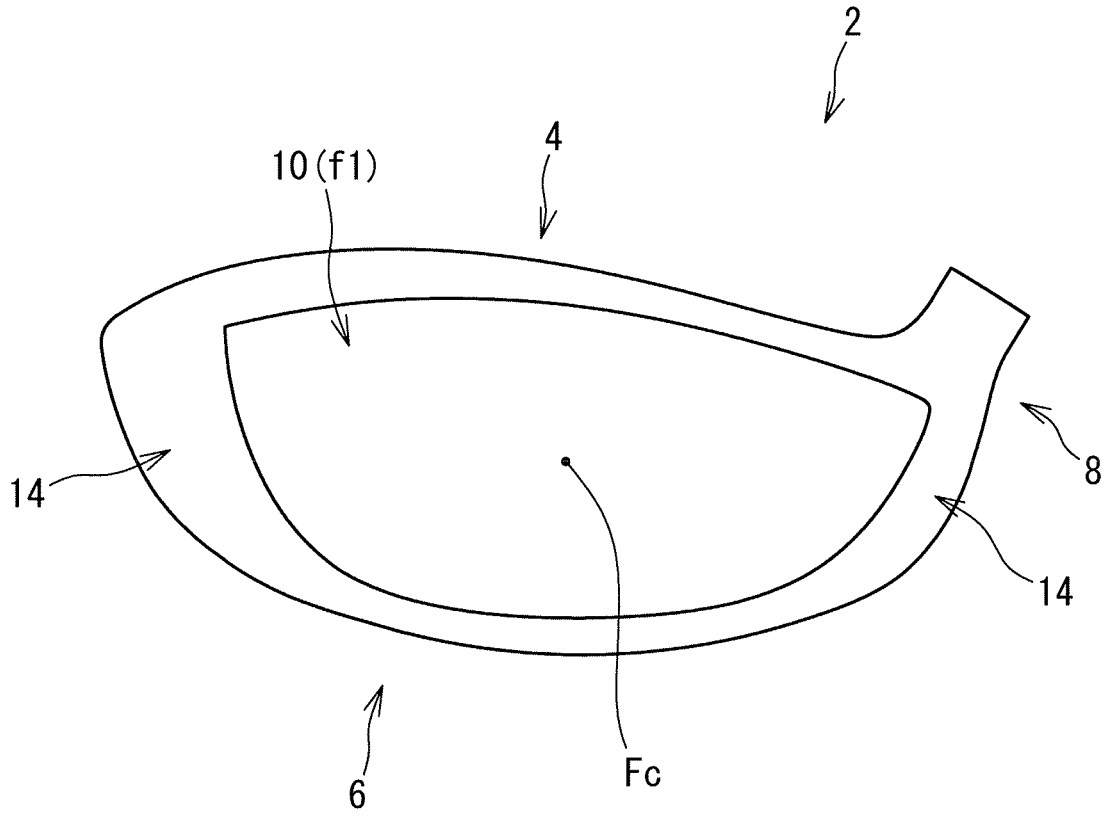
FIG. 1 is a front view of a head according to a first embodiment.
Figure 2:
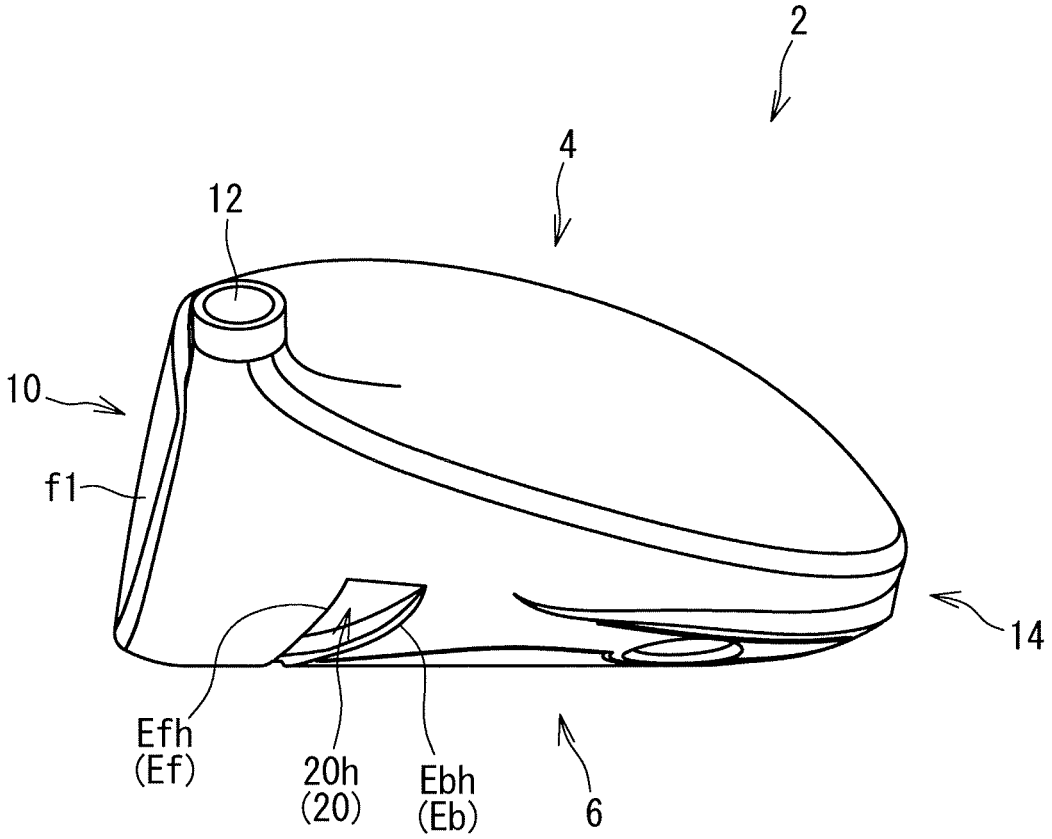
FIG. 2 is a side view of the head of FIG. 1 as viewed from a heel side.
Figure 3:
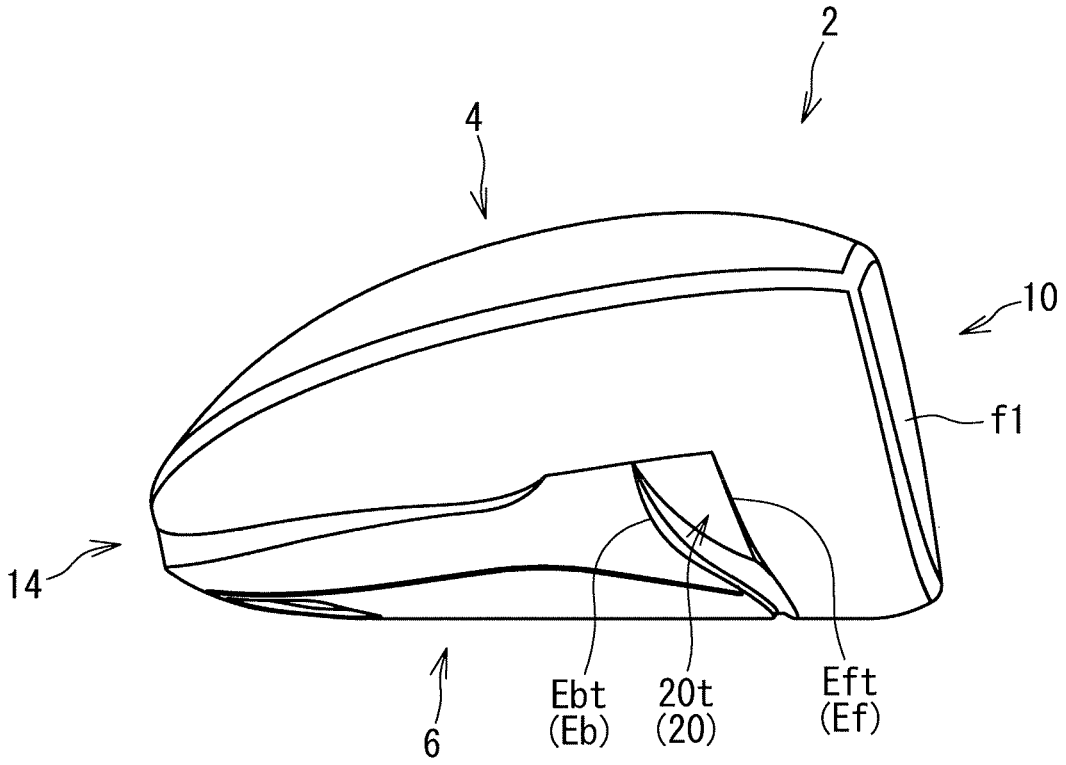
FIG. 3 is a side view of the head of FIG. 1 as viewed from a toe side.
Figure 4:
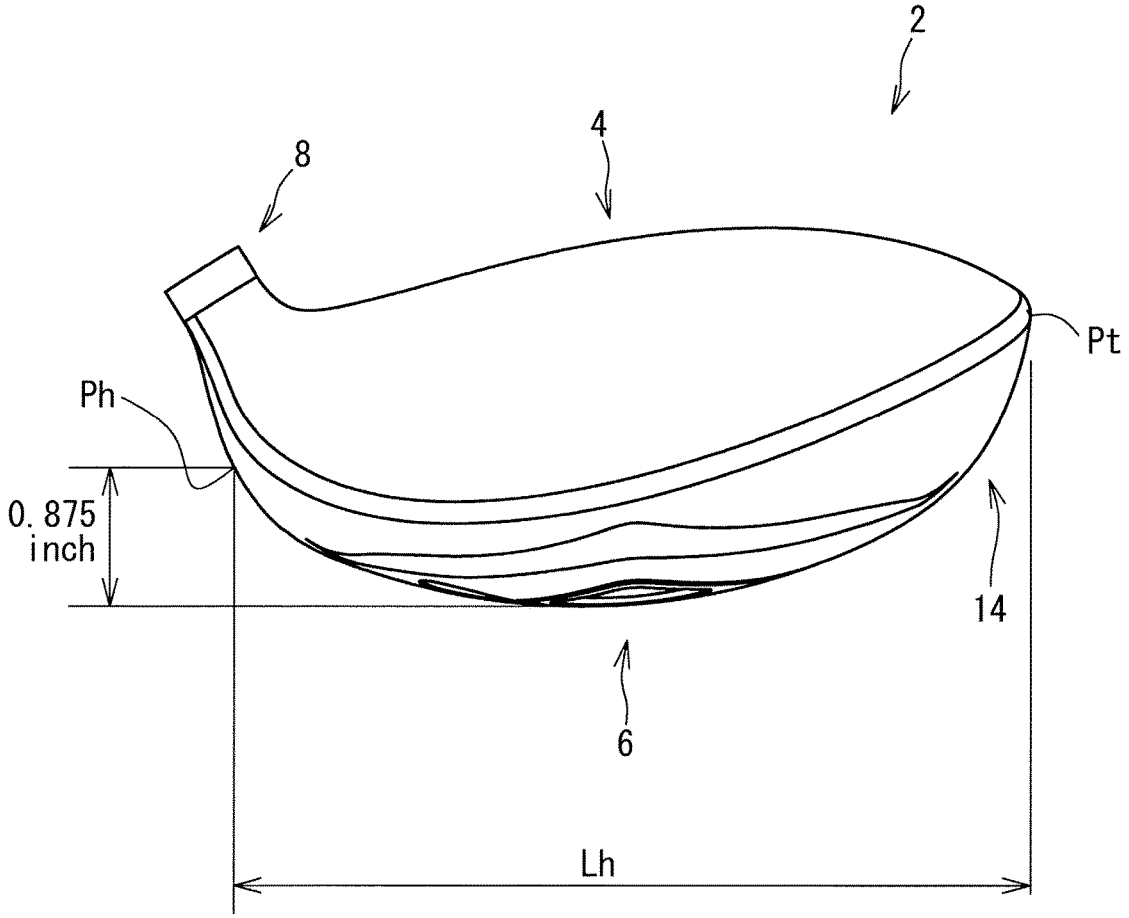
FIG. 4 is a rear view of the head of FIG. 1.
Figure 5:
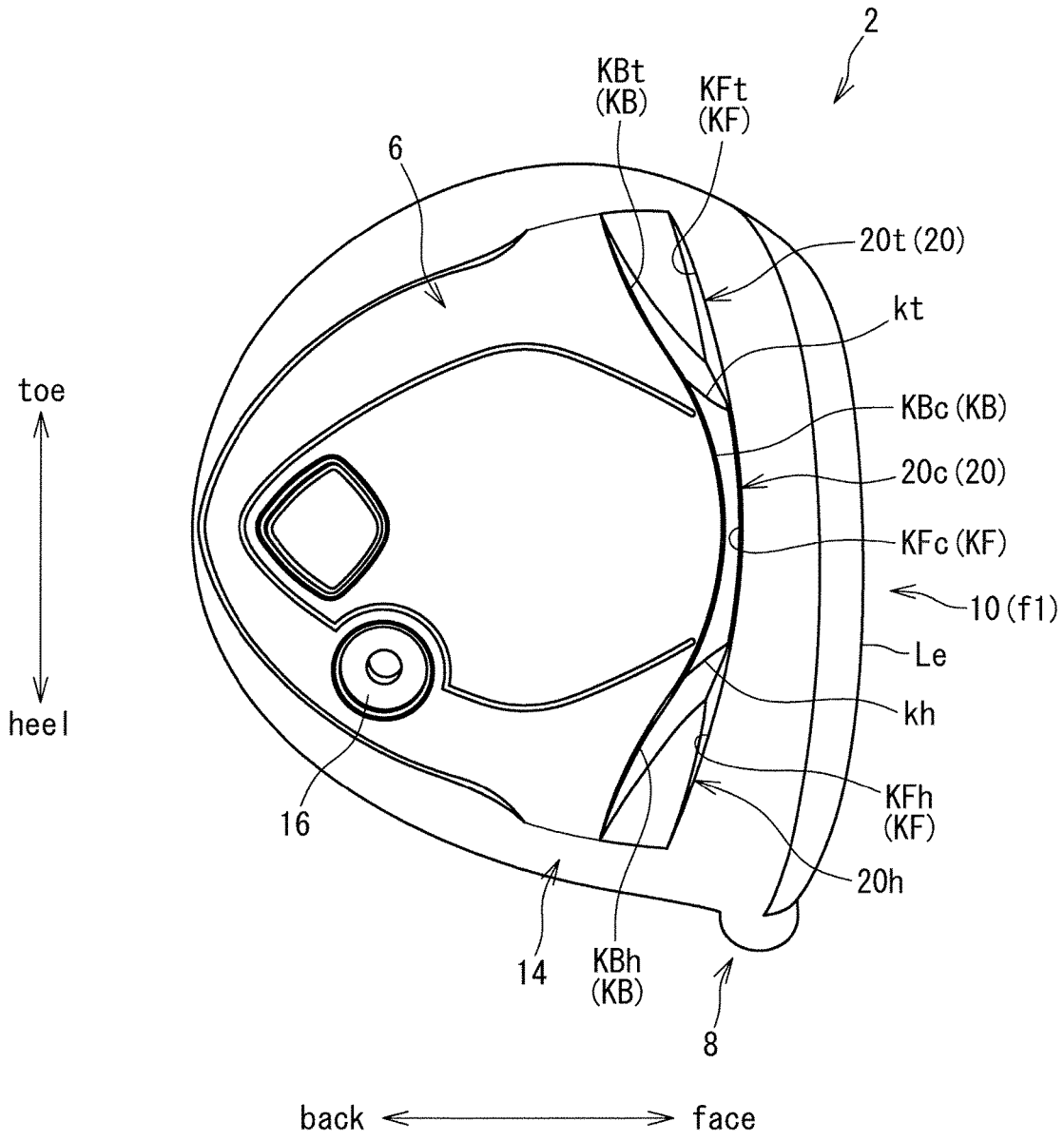
FIG. 5 is a bottom view of the head of FIG. 1.

FIG. 1 is a front view of a golf club head 2 according to a first embodiment. FIG. 2 is a side view of the head 2 as viewed from a heel side. FIG. 3 is a side view of the head 2 as viewed from a toe side. FIG. 4 is a rear view of the head 2. FIG. 5 is a bottom view of the head 2.

The head 2 is a wood type head. The head 2 is a so-called driver head. For example, the head 2 may be a hybrid type (utility type) head. The head 2 may be an iron type head. The head 2 may be a putter type head.

The head 2 includes a crown 4, a sole 6, a hosel 8, and a face 10. The crown 4 extends toward a back side from the upper edge of the face 10. The sole 6 extends toward the back side from the lower edge of the face 10. The outer surface of the face 10 is a hitting surface. The hitting surface is also referred to as a face surface fl. As shown in FIG. 2, the hosel 8 has a hosel hole 12.

Furthermore, the head 2 includes a side part 14. The side part 14 extends between the crown 4 and the sole 6. The side part 14 is also referred to as a skirt. The side part 14 may not exist. The head 2 includes a leading edge Le (see FIG. 5).

As shown in FIG. 5, the sole 6 includes a weight port 16. The weight port 16 forms a recess in the outer surface of the sole 6. A weight (not shown) is attached to the weight port 16.

The sole 6 includes a groove 20. As shown in FIG. 5, the groove 20 extends from the toe side to the heel side. A smooth curved surface is formed between the groove 20 and the leading edge Le. Other grooves do not exist between the groove 20 and the leading edge Le.

The groove 20 extends from the toe side edge of the sole 6 to the heel side edge of the sole 6. The groove 20 crosses the sole 6. The groove 20 crossing the sole 6 has an excellent effect of deforming the sole 6. The groove 20 contributes to an improvement in a coefficient of restitution. The groove 20 may come at the side part 14.

The groove 20 includes a center groove part 20*c*, a toe groove part 20*t* located on the toe side with respect to the center groove part 20*c*, and a heel groove part 20*h* located on the heel side with respect to the center groove part 20*c*. The center groove part 20*c* extends from a position on the toe side with respect to the face center Fc to a position on the heel side with respect to the face center Fc. The whole toe groove part 20*t* is located on the toe side with respect to the face center Fc. The whole heel groove part 20*h* is located on the heel side with respect to the face center Fc.

The depth of the groove 20 is not constant. That is, the depth of the groove 20 changes. The depth of the groove 20 changes at least near a toe boundary line kt and a heel boundary line kh. The depth of the groove 20 may change only near the toe boundary line kt and the heel boundary line kh. In the present application, the depth of the groove 20 is also referred to as a groove depth.

As shown in FIG. 5, the toe boundary line kt is formed on a boundary between the center groove part 20*c* and the toe groove part 20*t*. The heel boundary line kh is formed on a boundary between the center groove part 20*c* and the heel groove part 20*h*. The toe boundary line kt and the heel boundary line kh may not be present.

The toe boundary line kt is formed due to the change of the groove depth. The groove depth changes at least near the toe boundary line kt. In the present embodiment, the toe side groove depth of the toe boundary line kt is greater than the heel side groove depth of the toe boundary line kt near the toe boundary line kt. On the contrary, the toe side groove depth of the toe boundary line kt may be smaller than the heel side groove depth of the toe boundary line kt.

The toe boundary line kt is a line which can be visually recognized. The toe boundary line kt is a ridgeline. In the section taken along the face-back direction, the toe boundary line kt is a vertex. The vertex may have roundness, and the roundness preferably has a curvature radius of equal to or less than 7 mm.

The heel boundary line kh is formed due to the change of the groove depth. The groove depth changes at least near the heel boundary line kh. In the present embodiment, the heel side groove depth of the heel boundary line kh is greater than the toe side groove depth of the heel boundary line kh near the heel boundary line kh. On the contrary, the heel side groove depth of the heel boundary line kh may be smaller than the toe side groove depth of the heel boundary line kh.

The heel boundary line kh is a line which can be visually recognized. The heel boundary line kh is a ridgeline. In the section taken along the face-back direction, the heel boundary line kh is a vertex. The vertex may have roundness, and the roundness preferably has a curvature radius of equal to or less than 7 mm.

As shown in FIG. 5, the toe boundary line kt extends so as to be inclined with respect to the face-back direction. The toe boundary line kt is inclined outward toward a back side. The term "outward" means outward from the head 2. The toe boundary line kt is inclined so as to be located on the toe side toward the backside. The inclination direction may be opposite. That is, the toe boundary line kt may be inclined inward toward the back side. In other words, the toe boundary line kt may be inclined so as to be located on the heel side toward the back side. The inclination of the toe boundary line kt is determined in bottom plan view.

As shown in FIG. 5, the heel boundary line kh extends so as to be inclined with respect to the face-back direction. The heel boundary line kh is inclined outward toward the back side. The heel boundary line kh is inclined so as to be located on the heel side toward the back side. The inclination direction may be opposite. That is, the heel boundary line kh may be inclined inward toward the back side. In other words, the heel boundary line kh may be inclined so as to be located on the toe side toward the back side. The inclination of the heel boundary line kh is determined in bottom plan view.

Thus, in the present embodiment, the boundary lines kt and kh extend so as to be inclined with respect to the face-back direction. If the boundary lines kt and kh are taken along the face-back direction, a groove bottom surface is in a bent state in the boundary lines kt and kh. The bent portion has high rigidity against a force in the face-back direction. For this reason, the deformation of the sole 6 at the positions of the boundary lines kt and kh is inhibited, which causes large deterioration in the restitution performance at the positions. The deterioration in the restitution performance is suppressed by inclining the boundary lines kt and kh with respect to the face-back direction. Therefore, a change in the coefficient of restitution in the toe-heel direction can be reduced. As a result, a high restitution area can be extended. Variations in a coefficient of restitution due to hit points are suppressed.

The head according to the present disclosure may satisfy at least one of the following items (a) to (h):

(a) a groove depth Dc of the center groove part 20*c* is smaller than a groove depth Dt of the toe groove part 20*t;*

(b) the groove depth Dc of the center groove part 20*c* is smaller than a groove depth Dh of the heel groove part 20*h;*

(c) the groove depth Dc of the center groove part 20*c* is smaller than the groove depth Dt of the toe groove part 20*t*, and the groove depth Dc of the center groove part 20*c* is smaller than the groove depth Dh of the heel groove part 20*h;*

(d) the groove depth Dc of the center groove part 20*c* is greater than the groove depth Dt of the toe groove part 20*t;*

(e) the groove depth Dc of the center groove part 20*c* is greater than the groove depth Dh of the heel groove part 20*h;*

(f) the groove depth Dc of the center groove part 20*c* is greater than the groove depth Dt of the toe groove part 20*t*, and the groove depth Dc of the center groove part 20*c* is greater than the groove depth Dh of the heel groove part 20*h;*

(g) the groove depth Dc of the center groove part 20*c* is greater than the groove depth Dt of the toe groove part 20*t*, and the groove depth Dc of the center groove part 20*c* is smaller than the groove depth Dh of the heel groove part 20*h*; and (h) the groove depth Dc of the center groove part 20*c* is smaller than the groove depth Dt of the toe groove part 20*t*, and the groove depth Dc of the center groove part 20*c* is greater than the groove depth Dh of the heel groove part 20*h*.

The head 2 of the present embodiment satisfies the above item (a). That is, in the head 2, the groove depth Dc of the center groove part 20*c* is smaller than the groove depth Dt of the toe groove part 20*t*.

The head 2 of the present embodiment satisfies the above item (b). That is, in the head 2, the groove depth Dc of the center groove part 20*c* is smaller than the groove depth Dh of the heel groove part 20*h*.

The head 2 of the present embodiment satisfies the above item (c). That is, in the head 2, the groove depth Dc of the center groove part 20*c* is smaller than the groove depth Dt of the toe groove part 20*t*, and the groove depth Dc of the center groove part 20*c* is smaller than the groove depth Dh of the heel groove part 20*h*.

Figure 6:
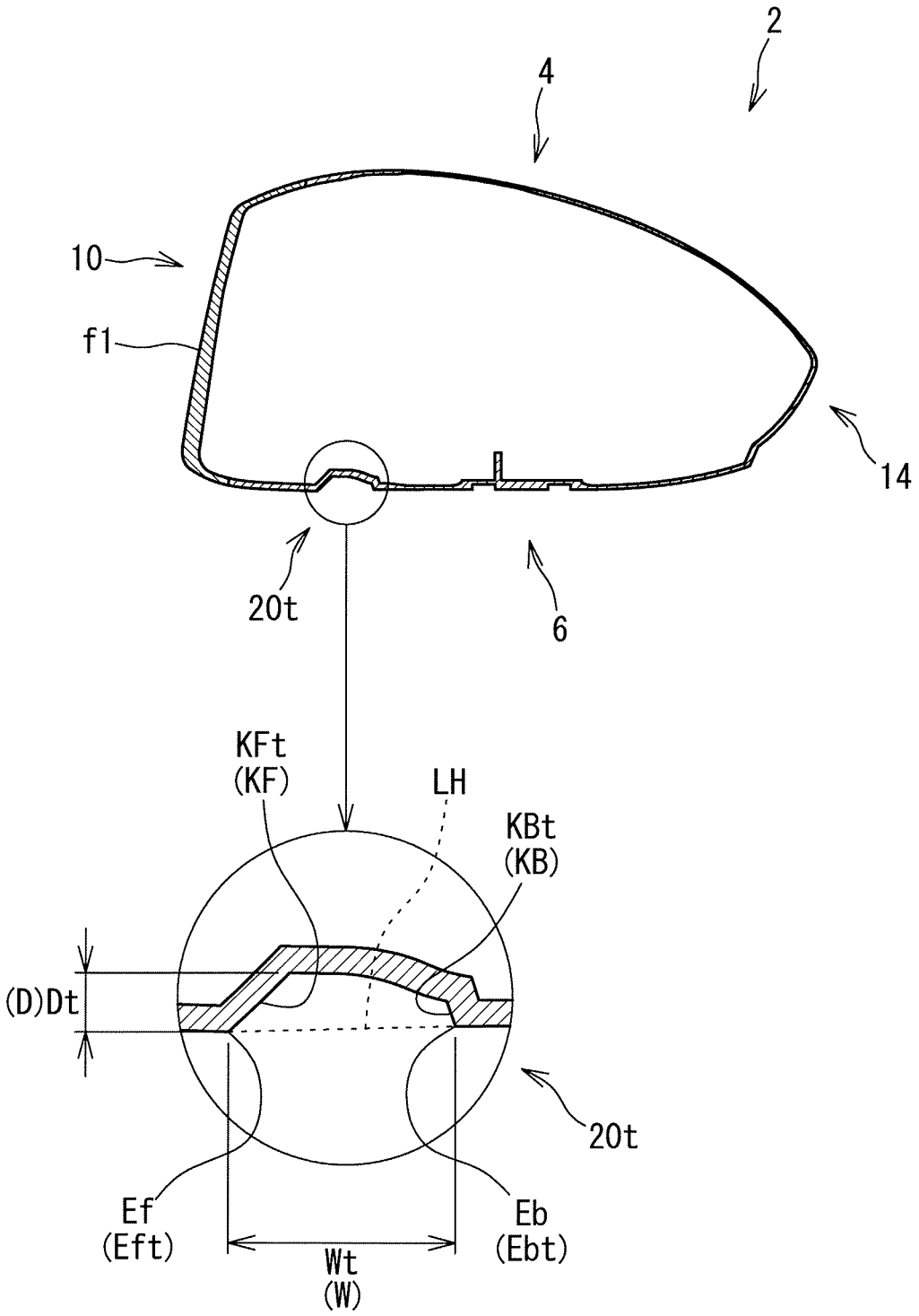
FIG. 6 is a sectional view of a head in the existence region of a toe groove part.
Figure 7:
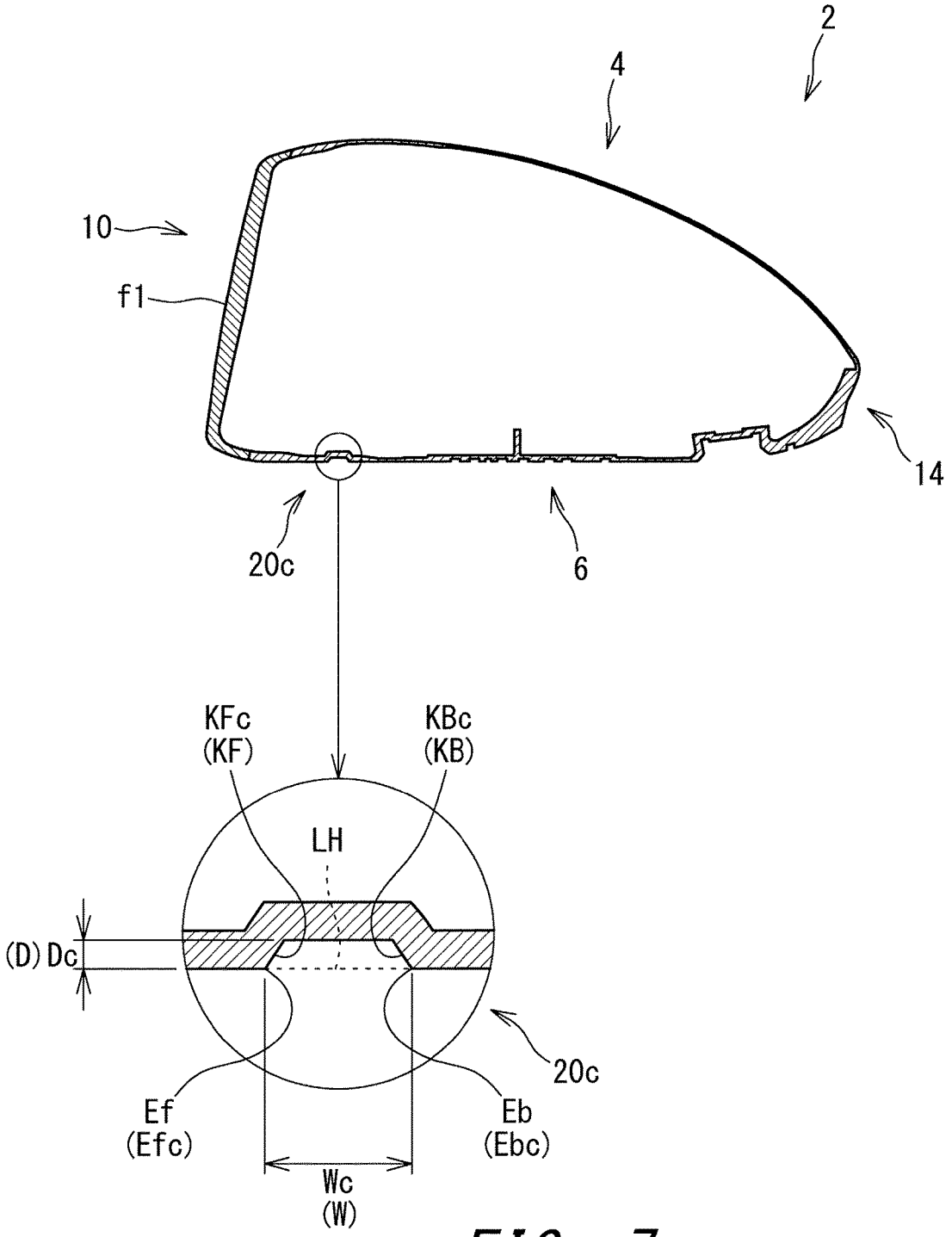
FIG. 7 is a sectional view of a head in the existence region of a center groove part.
Figure 8:
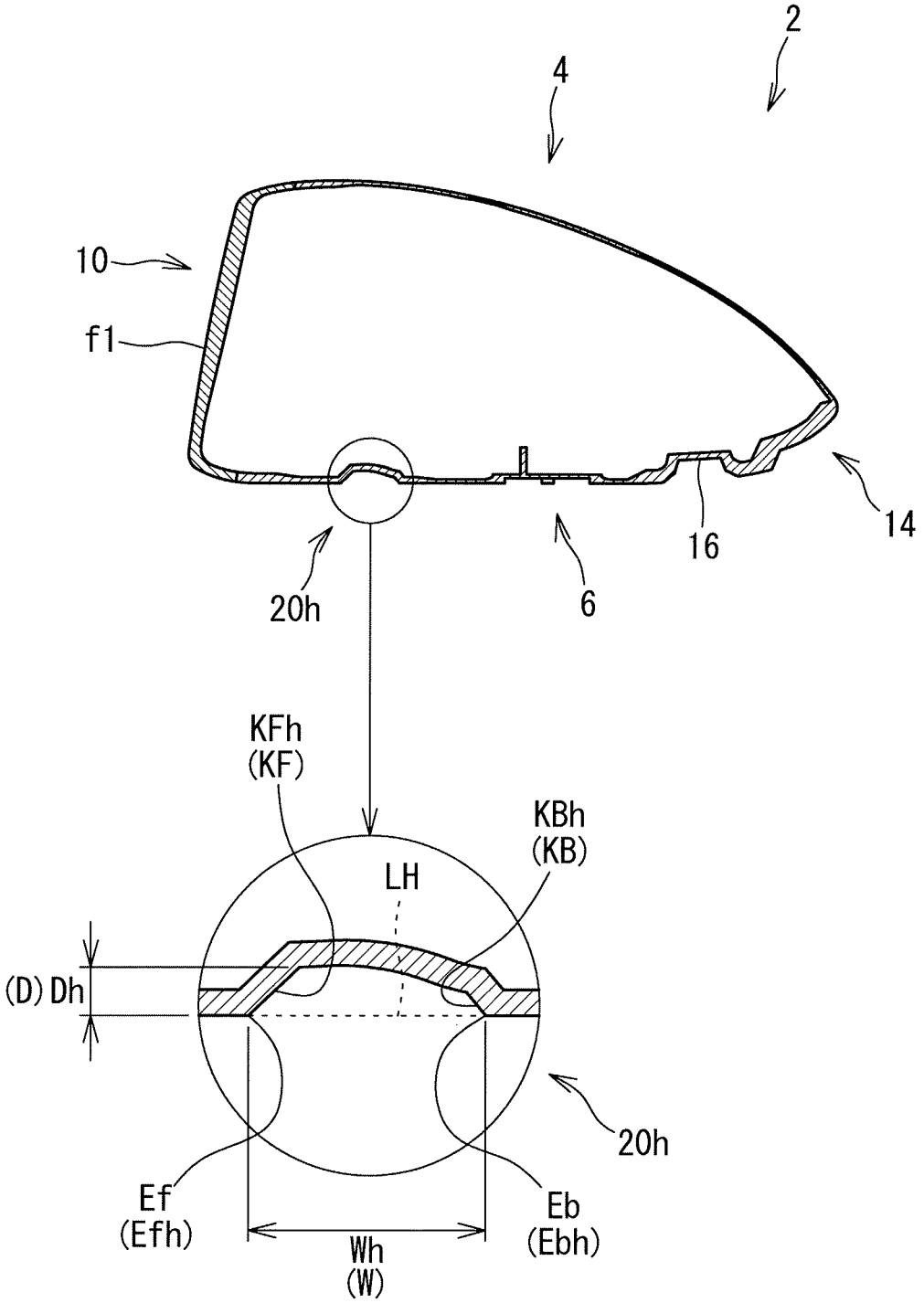
FIG. 8 is a sectional view of a head in the existence region of a heel groove part.

FIG. 6 is a sectional view of the head 2 in the existence region of the toe groove part 20*t*. FIG. 7 is a sectional view of the head 2 in the existence region of the center groove part 20*c*. FIG. 8 is a sectional view of the head 2 in the existence region of the heel groove part 20*h*. FIGS. 6, 7, and 8 are sectional views taken along the face-back direction and taken along the normal direction of a phantom lid surface CL2 (to be described later).

The inside of the head 2 is a space. The head 2 is a hollow head.

As shown in FIG. 6, the toe groove part 20*t* has a groove depth Dt and a groove width Wt. The toe groove part 20*t* forms a recess in the outer surface of the sole 6. Simultaneously, the toe groove part 20*t* forms a projection at a position corresponding to the recess in the inner surface of the sole 6. As shown in FIG. 6, the section of the toe groove part 20*t* (groove 20) is curved so that it projects toward the inner side of the head 2. The curved portion is likely to be deformed by a force in the face-back direction. The curved portion is likely to be deformed at impact.

As shown in FIG. 7, the center groove part 20*c* has a groove depth Dc and a groove width Wc. The center groove part 20*c* forms a recess in the outer surface of the sole 6. Simultaneously, the center groove part 20*c* forms a projection at a position corresponding to the recess in the inner surface of the sole 6. As shown in FIG. 7, the section of the center groove part 20*c* is curved so that it projects toward the inner side of the head 2.

As shown in FIG. 8, the heel groove part 20*h* has a groove depth Dh and a groove width Wh. The heel groove part 20*h* forms a recess in the outer surface of the sole 6. Simultaneously, the heel groove part 20*h* forms a projection at a position corresponding to the recess in the inner surface of the sole 6. As shown in FIG. 8, the section of the heel groove part 20*h* is curved so that it projects toward the inner side of the head 2.

As apparent from FIGS. 6 to 8, the groove 20 has a groove depth D and a groove width W. The groove 20 forms a recess in the outer surface of the sole 6. Simultaneously, the groove 20 forms a projection at a position corresponding to the recess in the inner surface of the sole 6. As shown in FIGS. 6 to 8, the section of the groove 20 is curved so that it projects toward the inner side of the head 2.

The groove depth D (Dt, Dc, Dh) is measured in the section taken along the face-back direction. The section is set at each position in the toe-heel direction. The maximum value of the groove depth in the section is the groove depth at the position in the toe-heel direction. The groove depth D (Dt, Dc, Dh) is measured along the normal direction of a phantom lid surface CL2 (to be described later). The phantom lid surface CL is a curved surface (see FIG. 10), and the normal direction of the phantom lid surface CL changes depending on the position in the toe-heel direction.

A phantom lid line LH is shown by a dashed line in an enlarged part in each of FIGS. 6 to 8. The phantom lid line LH is a straight line passing through a face side groove edge Ef and a back side groove edge Eb. The groove depth D (Dt, Dc, Dh) is a distance between the phantom lid line LH and the deepest point of the groove.

The groove width W (Wt, Wc, Wh) is measured in the section taken along the face-back direction. The groove width W (Wt, Wc, Wh) is a distance between the face side groove edge Ef and the back side groove edge Eb. The groove width W (Wt, Wc, Wh) is measured along the face-back direction.

As shown in FIGS. 5 to 8, the groove 20 includes a face side inner wall surface KF. As shown in FIG. 6, the toe groove part 20*t* includes a face side inner wall surface KFt. The inner wall surface KFt is a part of the inner wall surface KF. As shown in FIG. 7, the center groove part 20*c* includes a face side inner wall surface KFc. The inner wall surface KFc is a part of the inner wall surface KF. As shown in FIG. 8, the heel groove part 20*h* includes a face side inner wall surface KFh. The inner wall surface KFh is a part of the inner wall surface KF. The inner wall surface KFt and the inner wall surface KFc are smoothly joined to each other. The inner wall surface KFc and the inner wall surface KFh are smoothly joined to each other.

As shown in FIGS. 5 to 8, the groove 20 includes a back side inner wall surface KB. As shown in FIG. 6, the toe groove part 20*t* includes a back side inner wall surface KBt. The inner wall surface KBt is a part of the inner wall surface KB. As shown in FIG. 7, the center groove part 20*c* includes a back side inner wall surface KBc. The inner wall surface KBc is a part of the inner wall surface KB. As shown in FIG. 8, the heel groove part 20*h* includes a back side inner wall surface KBh. The inner wall surface KBh is a part of the inner wall surface KB. The inner wall surface KBt and the inner wall surface KBc are smoothly joined to each other. The inner wall surface KBc and the inner wall surface KBh are smoothly joined to each other.

As shown in FIG. 5, the toe boundary line kt is smoothly joined to the back side inner wall surface KB. Meanwhile, in the present embodiment, the toe boundary line kt is not smoothly joined to the face side inner wall surface KF. The toe boundary line kt may be smoothly joined to the face side inner wall surface KF.

As shown in FIG. 5, the heel boundary line kh is smoothly joined to the back side inner wall surface KB. Meanwhile, in the present embodiment, the heel boundary line kh is not smoothly joined to the face side inner wall surface KF. The heel boundary line kh may be smoothly joined to the face side inner wall surface KF.

Figure 9:
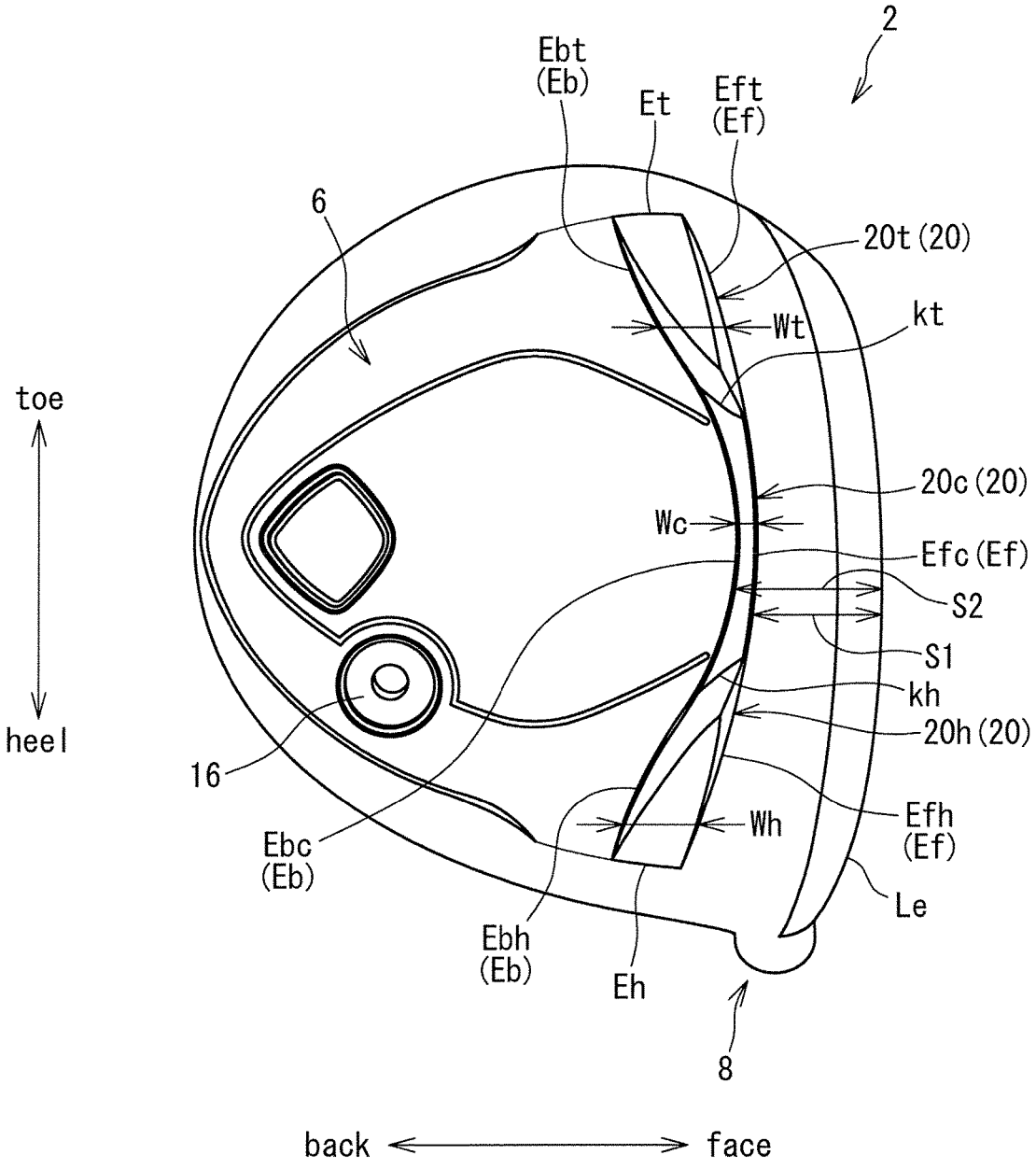
FIG. 9 is the same bottom view as FIG. 5.

FIG. 9 is the same bottom view as FIG. 5. Reference characters are crowded in FIG. 5, and FIG. 9 is additionally used in light of viewability.

The groove 20 includes a toe end Et and a heel end Eh. In the toe end Et, the groove depth D is zero. In the heel end Eh, the groove depth D is zero.

As shown in FIG. 9, a ridgeline is formed in the toe end Et. The ridgeline is a boundary line between the surface (side surface and bottom surface) of the groove 20 and the outer surface of the head (portion having no groove) adjoining the toe side of the surface of the groove 20. The boundary line includes no step. The ridgeline may not be present. That is, the outer surface of the head adjoining the toe side of the toe end Et and the surface of the groove 20 may be smoothly joined to each other. In the present embodiment, the outer surface of the head adjoining the toe side of the toe end Et is the outer surface of the side part 14.

As shown in FIG. 9, a ridgeline is formed in the heel end Eh. The ridgeline is a boundary line between the surface (side surface and bottom surface) of the groove 20 and the outer surface of the head (portion having no groove) adjoining the heel side of the surface of the groove 20. The boundary line includes no step. The ridgeline may not be present. That is, the outer surface of the head adjoining the heel side of the heel end Eh and the surface of the groove 20 may be smoothly joined to each other. In the present embodiment, the outer surface of the head adjoining the heel side of the heel end Eh is the outer surface of the side part 14.

A distance between the leading edge Le and the face side groove edge Ef is shown by a double-headed arrow S1 in FIG. 9. The distance S1 is measured along the face-back direction. The distance S1 is measured in bottom plan view.

A distance between the leading edge Le and the back side groove edge Eb is shown by a double-headed arrow S2 in FIG. 9. The distance S2 is measured along the face-back direction. The distance S2 is measured in bottom plan view.

As described above, the groove 20 includes the face side groove edge Ef and the back side groove edge Eb. In the bottom face view, the face side groove edge Ef is a curve line projecting toward the face side.

The face side groove edge Ef includes a groove edge Eft. The face side groove edge Ef in the toe groove part 20*t* is the groove edge Eft. The groove edge Eft is a curve line projecting toward the face side.

The face side groove edge Ef includes a groove edge Efc. The face side groove edge Ef in the center groove part 20*c* is the groove edge Efc. The groove edge Efc is a curve line projecting toward the face side.

The face side groove edge Ef includes a groove edge Efh. The face side groove edge Ef in the heel groove part 20*h* is the groove edge Efh. The groove edge Efh is a curve line projecting toward the face side.

The groove edge Eft and the groove edge Efc are smoothly joined to each other. The groove edge Efc and the groove edge Efh are smoothly joined to each other.

The groove edge Efc of the center groove part 20*c* is located forward (face side) with respect to the groove edge Eft of the toe groove part 20*t*. The groove edge Efc of the center groove part 20*c* is located forward (face side) with respect to the groove edge Efh of the heel groove part 20*h*.

The back side groove edge Eb includes a groove edge Ebt. The back side groove edge Eb in the toe groove part 20*t* is the groove edge Ebt. The groove edge Ebt is a curve line projecting toward the back side.

The back side groove edge Eb includes a groove edge Ebc. The back side groove edge Eb in the center groove part 20*c* is the groove edge Ebc. The groove edge Ebc is a curve line projecting toward the face side.

The back side groove edge Eb includes a groove edge Ebh. The back side groove edge Eb in the heel groove part 20*h* is the groove edge Ebh. The groove edge Ebh is a curve line projecting toward the back side.

The groove edge Ebt and the groove edge Ebc are smoothly joined to each other. The groove edge Ebc and the groove edge Ebh are smoothly joined to each other.

The groove edge Ebc of the center groove part 20*c* is located forward (face side) with respect to the groove edge Ebt of the toe groove part 20*t*. The groove edge Ebc of the center groove part 20*c* is located forward (face side) with respect to the groove edge Ebh of the heel groove part 20*h*.

As described above, the toe groove part 20*t* has the groove width Wt. The center groove part 20*c* has the groove width Wc. The heel groove part 20*h* has the groove width Wh.

As shown in FIG. 9, the groove width Wt is greater than the groove width Wc. That is, except for the existence region of the toe boundary line kt, the minimum value of the groove width Wt is greater than the maximum value of the groove width Wc.

As shown in FIG. 9, the groove width Wh is greater than the groove width Wc. That is, except for the existence region of the heel boundary line kh, the minimum value of the groove width Wh is greater than the maximum value of the groove width Wc.

Figure 10:
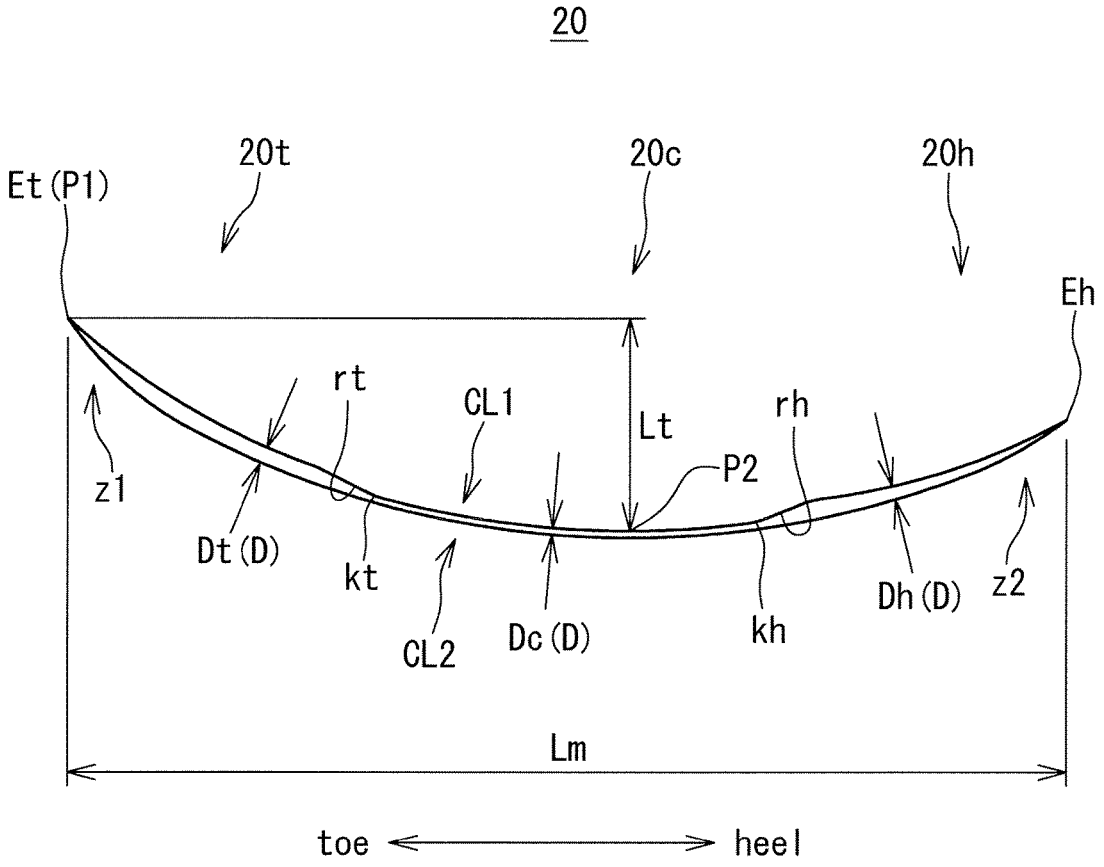
FIG. 10 is a front view showing the distribution of a groove depth.

FIG. 10 is a view of the distribution of the groove depth D as viewed from the face side. A curve line CL1 (upper line) shows the bottom surface (deepest point) of the groove 20. A curve line CL2 (lower line) shows a phantom lid surface. The phantom lid surface CL2 is a surface constituted by the assembly of the above-mentioned phantom lid lines LH. That is, FIG. 10 shows the bottom surface CL1 of the groove 20 and the phantom lid surface CL2 when the section taken along the deepest point of the groove 20 is viewed from the face side.

As shown in FIG. 10, the average value of the groove depth Dt of the toe groove part 20*t* is greater than the average value of the groove depth Dc of the center groove part 20*c*. The maximum value of the groove depth Dt is greater than the maximum value of the groove depth Dc.

As shown in FIG. 10, the average value of the groove depth Dh of the heel groove part 20*h* is greater than the average value of the groove depth Dc of the center groove part 20*c*. The maximum value of the groove depth Dh is greater than the maximum value of the groove depth Dc.

The groove 20 (toe groove part 20*t*) includes a toe transition part rt. The toe transition part rt is provided so as to adjoin the toe side of the toe boundary line kt. In the toe transition part rt, the groove depth D is (gradually) increased toward the toe side. The toe transition part rt smoothly joins the bottom surface of the center groove part 20*c* and the bottom surface of the toe groove part 20*t* to each other. The toe transition part rt suppresses a rapid change in the rigidity of the sole 6 near the toe boundary line kt in the toe-heel direction. As a result, in the toe-heel direction, a rapid change in the restitution performance of the head 2 near the toe boundary line kt is suppressed.

The groove 20 (heel groove part 20*h*) includes a heel transition part rh. The heel transition part rh is provided so as to adjoin the heel side of the heel boundary line kh. In the heel transition part rh, the groove depth D is (gradually) increased toward the heel side. The heel transition part rh smoothly joins the bottom surface of the center groove part 20*c* and the bottom surface of the heel groove part 20*h* to each other. The heel transition part rh suppresses a rapid change in the rigidity of the sole 6 near the heel boundary line kh in the toe-heel direction. As a result, in the toe-heel direction, a rapid change in the restitution performance of the head 2 near the heel boundary line kh is suppressed.

The toe groove part 20*t* includes a depth decrease part z1 having a groove depth D gradually decreased toward the toe side. The depth decrease part z1 occupies the toe side end part of the toe groove part 20*t*. The heel groove part 20*h* includes a depth decrease part z2 having a groove depth D gradually decreased toward the heel side. The depth decrease part z2 occupies the heel side end part of the heel groove part 20*h*.

As apparent from FIG. 10, the head 2 satisfies the following item (x). The head 2 satisfies the following item (y). That is, the head 2 satisfies the following item (z).

(x) The groove depth D is gradually decreased as the groove depth ID approaches the toe end Et in the toe side end part of the groove 20, and the groove depth D becomes zero in the toe end Et.

(y) The groove depth D is gradually decreased as the groove depth ID approaches the heel end Eh in the heel side end part of the groove 20, and the groove depth ID becomes zero in the heel end Eh.

(z) The groove depth D is gradually decreased as the groove depth D approaches the toe end Et in the toe side end part of the groove 20, and the groove depth D becomes zero in the toe end Et; and the groove depth D is gradually decreased as the groove depth D approaches the heel end Eh in the heel side end part of the groove 20, and the groove depth D becomes zero in the heel end Eh.

The toe side end part of the groove 20 may be defined as a portion in which a toe-heel direction distance from the toe end Et is equal to or less than 5 mm. The heel side end part of the groove 20 may be defined as a portion in which a toe-heel direction distance from the heel end Eh is equal to or less than 5 mm.

In the head 2, the whole groove 20 is located below the face center Fc. In other words, a point located on the uppermost side on the surface of the groove 20 is located below the face center Fc. As shown in FIG. 10, in the present embodiment, the toe end Et is located on the uppermost side on the surface of the groove 20. The toe end Et is located below the face center Fc. The heel end Eh is located below the toe end Et.

As shown in FIG. 10, the bottom part of the groove 20 is curved so that it projects to a lower side along the shape of the sole 6. The bottom part of the groove 20 means the bottom surface of the groove 20. The bottom surface includes the deepest point of the groove 20. In the case where the bottom surface is not present such as a V-shaped sectional shape, the bottom part of the groove 20 means the deepest point of the groove 20. In FIG. 10, the curve line CL1 (upper line) shows the bottom part of the groove 20.

"Along the shape of the sole 6" means that an up-down direction distance between the curve line CL1 (upper line) and the curve line CL2 (lower line) is equal to or less than 5 mm at all positions in the toe-heel direction. In other words, "along the shape of the sole 6" means that the groove depth D is equal to or less than 5 mm at all positions in the toe-heel direction.

In the head 2, the maximum value of the groove depth D is equal to or less than 15% of the height of the center of gravity of the head 2. Furthermore, in the head 2, the maximum value of the groove depth D is equal to or less than 10% of the height of the center of gravity of the head. The maximum value of the groove depth D is equal to or greater than 5% of the height of the center of gravity of the head 2. In the present embodiment, the maximum value of the groove depth D is 2.2 mm, and the height of the center of gravity of the head 2 is 25.5 mm.

The toe-heel direction length of the groove 20 is shown by a double-headed arrow Lm in FIG. 10. The toe-heel direction width of the head 2 is shown by a double-headed arrow Lh in FIG. 4. The width Lh is a distance between a point Pt and a point Ph. The point Pt is a point located on the most toe side in the head 2. The point Ph is a point located on the most heel side among points having heights of 0.875 inches (22.23 mm) from the horizontal plane HP in the head 2. In the above-mentioned reference state, the point Pt and point Ph are determined. The existence range of the groove 20 in the toe-heel direction is extended by increasing Lm/Lh, to improve the restitution performance. From this viewpoint, Lm/Lh is preferably equal to or greater than 0.7, more preferably equal to or greater than 0.72, and still more preferably equal to or greater than 0.74. When Lm/Lh is too large, the toe end Et and the heel end Eh of the groove 20 approach the crown 4. This is apt to cause the high position of the center of gravity of the head. From this viewpoint, Lm/Lh is preferably equal to or less than 0.92, more preferably equal to or less than 0.90, and still more preferably equal to or less than 0.88.

The groove 20 is deformed at impact. The groove 20 facilitates the deformation of the sole 6 at impact. The groove 20 is deformed so that it is shrunk in the face-back direction by the impact. The deformation is elastic deformation. The deformation is restored. The restoration contributes to an improvement in restitution performance.

Meanwhile, a weight is required for the formation of the groove 20. At least the side surface of the groove 20 provides an additional weight as compared with a flat sole portion. Therefore, the weight of the formed sole portion is increased by the formation of the groove 20. Thus, the groove 20 creates the added weight.

When the groove 20 is largely extended in the toe-heel direction, both the end parts of the groove 20 come at the side part 14 (skirt part). When the groove 20 is largely extended, both the end parts of the groove 20 approach the crown 4. In this case, both the end parts of the groove 20 are at a high position. However, in this case, the additional weight due to the formation of the groove 20 is distributed to the high position. Therefore, the position of the center of gravity of the head is heightened. When the center of gravity of the head is heightened, a launch angle is decreased, and backspin is increased. These initial conditions decrease a flight distance.

In the present embodiment, the whole groove 20 is located below the face center Fc. Therefore, the added weight due to the groove 20 is distributed to the lower side of the head 2. As a result, the position of the center of gravity of the head is lowered as compared with a head in which the above-mentioned groove 20 is largely extended to the vicinity of the crown 4. In the head 2 having a low center of gravity, a launch angle is increased, and backspin is suppressed. These initial conditions increase a flight distance.

When the groove depth D is too large, the bottom surface of the groove 20 is accordingly located on a further upper side. Therefore, the position of the center of gravity of the head is heightened. From this viewpoint, the maximum value of the groove depth D is preferably equal to or less than 3.2 mm, more preferably equal to or less than 2.7 mm, and still more preferably equal to or less than 2.2 mm. From the viewpoint of the restitution performance, the maximum value of the groove depth D is preferably equal to or greater than 0.8 mm, more preferably equal to or greater than 1.3 mm, and still more preferably equal to or greater than 1.8 mm.

The up-down direction existence height of the groove 20 is shown by a double-headed arrow Lt in FIG. 10. The height Lt is measured based on the above-mentioned curve line CL1. In the curve line CL1, a point P1 located on the uppermost side is determined. The point P1 is also referred to as an uppermost point. Furthermore, in the curve line CL1, a point P2 located on the lowermost side is determined. The point P2 is also referred to as a lowermost point. The height Lt is an up-down direction height between the point P1 and the point P2. As described above, the double-headed arrow Lm is the toe-heel direction length of the groove 20.

As shown in FIG. 10, the uppermost point P1 is located in the toe end Et. The uppermost point P1 is preferably located in the toe end Et or the heel end Eh, and more preferably located in the toe end Et. The lowermost point P2 is preferably located in the center groove part 20*c*.

From the viewpoint of improving the restitution performance while lowering the center of gravity of the head, Lt/Lm is preferably equal to or less than 0.95, more preferably equal to or less than 0.90, and still more preferably equal to or less than 0.85. In light of the shape of the sole 6, a too small height Lt is not preferable. From this viewpoint, Lt/Lm is preferably equal to or greater than 0.50, more preferably equal to or greater than 0.55, and still more preferably equal to or greater than 0.60.

As described above, the groove depth D of the groove 20 is not constant. As the groove depth D is deeper, the contribution to the restitution performance is likely to be increased. By changing the groove depth D, the deformation degree of the groove 20 can be adjusted for every region in the toe-heel direction. By changing the groove depth D, the degree of freedom of design of restitution distribution is increased.

The head according to the present disclosure preferably satisfies at least one of the following items (a) to (c).

(a) the groove depth Dc of the center groove part 20*c* is smaller than the groove depth Dt of the toe groove part 20*t;*

(b) the groove depth Dc of the center groove part 20*c* is smaller than the groove depth Dh of the heel groove part 20*h;*

(c) the groove depth Dc of the center groove part 20*c* is smaller than the groove depth Dt of the toe groove part 20*t*, and the groove depth Dc of the center groove part 20*c* is smaller than the groove depth Dh of the heel groove part 20*h*.

The center part of the face is apt to be deformed compared with the peripheral part of the face. Therefore, the coefficient of restitution of the center part of the face has a tendency to be higher than the coefficient of restitution of the peripheral part of the face. As shown in the above items (a) to (c), by setting the groove depth Dc to be comparatively small, a rise in the coefficient of restitution can be suppressed in the center part having a tendency to have a high coefficient of restitution, and the coefficient of restitution can be increased in the peripheral part having a tendency to have a low coefficient of restitution. Therefore, the coefficient of restitution at each position in the toe-heel direction can be increased as a whole. As a result, the high restitution area can be extended.

From the viewpoint of extending the high restitution area, the groove depth Dh is preferably equal to or greater than 0.5 mm, more preferably equal to or greater than 0.7 mm, and still more preferably equal to or greater than 1.0 mm. From the viewpoint of keeping the center of gravity of the head low, the groove depth Dh is preferably equal to or less than 10 mm, more preferably equal to or less than 7 mm, and still more preferably equal to or less than 5 mm.

From the viewpoint of extending the high restitution area, the groove depth Dt is preferably equal to or greater than 0.5 mm, more preferably equal to or greater than 0.7 mm, and still more preferably equal to or greater than 1.0 mm. From the viewpoint of keeping the center of gravity of the head low, the groove depth Dt is preferably equal to or less than 10 mm, more preferably equal to or less than 7 mm, and still more preferably equal to or less than 5 mm.

From the viewpoint of extending the high restitution area, the rise width of the coefficient of restitution in the center part of the face is preferably suppressed compared with the rise width of the coefficient of restitution of the peripheral part of the face. From this viewpoint, the groove depth Dc is preferably equal to or less than 5 mm, more preferably equal to or less than 4 mm, and still more preferably equal to or less than 3 mm. Meanwhile, the coefficient of restitution of the center part of the face is preferably also increased in a range where it is not excessive. From this viewpoint, the groove depth Dc is preferably equal to or greater than 0.5 mm, more preferably equal to or greater than 0.7 mm, and still more preferably equal to or greater than 1.0 mm.

Herein, the maximum value of the groove depth Dh is defined as a groove depth Dh1; the maximum value of the groove depth Dc is defined as Dc1; and the maximum value of the groove depth Dt is defined as Dt1.

From the viewpoint of reducing the change in the coefficient of restitution, it is not preferable that Dh1/Dc1 is too large or too small. Dh1/Dc1 is preferably equal to or greater than 1.5, more preferably equal to or greater than 2.0, and still more preferably equal to or greater than 2.5. Dh1/Dc1 is preferably equal to or less than 6, more preferably equal to or less than 5, and still more preferably equal to or less than 4.

From the viewpoint of reducing the change in the coefficient of restitution, it is not preferable that Dt1/Dc1 is too large or too small. Dt1/Dc1 is preferably equal to or greater than 1.5, more preferably equal to or greater than 2.0, and still more preferably equal to or greater than 2.5. Dt1/Dc1 is preferably equal to or less than 6, more preferably equal to or less than 5, and still more preferably equal to or less than 4.

From the viewpoint of lowering the height of the center of gravity of the head, the groove depth Dh1 is preferably equal to or less than 15% of the height of the center of gravity of the head 2, and more preferably equal to or less than 10%. From the viewpoint of the restitution performance when hitting on the heel side, the groove depth Dh1 is preferably equal to or greater than 5% of the height of the center of gravity of the head 2. In the present embodiment, the groove depth Dh1 is 2.2 mm.

From the viewpoint of lowering the height of the center of gravity of the head, the groove depth Dt1 is preferably equal to or less than 15% or less of the height of the center of gravity of the head 2, and more preferably equal to or less than 10%. From the viewpoint of the restitution performance when hitting on the toe side, the groove depth Dt1 is preferably equal to or greater than 5% of the height of the center of gravity of the head 2. In the present embodiment, the groove depth Dt1 is 2.2 mm.

From the viewpoint of extending the high restitution area, the coefficient of restitution in the center part of the face is preferably suppressed compared with the coefficient of restitution of the peripheral part of the face. From this viewpoint, the groove depth Dc1 is preferably equal to or less than 7% of the height of the center of gravity of the head 2, and more preferably equal to or less than 5%. From the viewpoint of the restitution performance in the center part of the face, the groove depth Dc1 is preferably equal to or greater than 2% of the height of center of gravity of the head 2, and more preferably equal to or greater than 3%. In the present embodiment, the groove depth Dc1 is 0.8 mm.

As shown in the above items (a) to (c), the moment of inertia of the head 2 can be increased by comparatively increasing the groove depth Dh and/or Dt. As the groove depth D is increased, an added weight due to the groove 20 is increased. Therefore, a more weight is distributed to the toe side and/or the heel side of the head 2 by increasing the groove depth Dh and/or Dt. For this reason, the moment of inertia (lateral moment of inertia) of the head 2 is increased. As a result, the high restitution area can be further extended.

If an axis passing through the center of gravity of the head and extending in the up-down direction is defined as an up-down reference axis, the lateral moment of inertia is a moment of inertia about the up-down reference axis.

As described above, the toe boundary line kt is smoothly joined to the back side inner wall surface KB (see FIG. 5). The heel boundary line kh is smoothly joined to the back side inner wall surface KB. By these constitutions, the change in the coefficient of restitution can be further reduced.

Unlike the present embodiment, the toe boundary line kt may be smoothly joined to the face side inner wall surface KF. The heel boundary line kh may be smoothly joined to the face side inner wall surface KF. Also in this case, the change in the coefficient of restitution can be further reduced.

As described above, the head according to the present disclosure may satisfy at least one of the above-mentioned items (d) to (h). For example, when the coefficient of restitution of the center part of the face is desired to be particularly increased, at least one of the above-mentioned items (d) to (f) can be adopted. For example, by selecting a position where the groove depth D is increased, the high restitution area may be set according to each golfer's hit points.

The center part of the face is apt to be deformed compared with the peripheral part of the face. Therefore, the coefficient of restitution of the center part of the face has a tendency to be higher than the coefficient of restitution of the peripheral part of the face. By setting the groove width Wc to be comparatively smaller than the groove widths Wt and Wh, a rise in the coefficient of restitution can be suppressed in the center part having a tendency to have a high coefficient of restitution, and the coefficient of restitution can be increased in the peripheral part having a tendency to have a low coefficient of restitution. Therefore, the coefficient of restitution at each position in the toe-heel direction can be increased as a whole. As a result, the high restitution area can be extended.

In view of such a point, a ratio of a maximum value Wt1 of the groove width Wt to a maximum value Wc1 of the groove width Wc may be considered. From the viewpoint of extending the high restitution area, Wt1/Wc1 is preferably equal to or greater than 1.2, more preferably equal to or greater than 1.5, and still more preferably equal to or greater than 2.0. In light of the balance of the coefficient of restitution, too large Wt1/Wc1 is not preferable. Therefore, Wt1/Wc1 is preferably equal to or less than 5, more preferably equal to or less than 4.5, and still more preferably equal to or less than 4.

Similarly, a ratio of a maximum value Wh1 of the groove width Wh to the maximum value Wc1 of the groove width We may be considered. From the viewpoint of extending the high restitution area, Wh1/Wc1 is preferably equal to or greater than 1.2, more preferably equal to or greater than 1.5, and still more preferably equal to or greater than 2.0. In light of the balance of the coefficient of restitution, too large Wh1/Wc1 is not preferable. Therefore, Wh1/Wc1 is preferably equal to or less than 5, more preferably equal to or less than 4.5, and still more preferably equal to or less than 4.

As described above, FIG. 9 shows the distance S1 between the leading edge Le and the groove edge Ef. When a force acting on the sole 6 at impact is analyzed, a region having high stress acting on the sole 6 is not necessarily near the face 10. The deformation of the groove 20 can be increased by disposing the groove 20 at the position having high stress.

From the viewpoint of obtaining the restitution performance due to the deformation of the groove 20, it is not preferable that S1 is too small or too large. From the viewpoint of the restitution performance, the distance S1 is preferably equal to or greater than 15 mm, more preferably equal to or greater than 18 mm, and still more preferably equal to or greater than 21 mm. From the viewpoint of the restitution performance, the distance S1 is preferably equal to or less than 35 mm, more preferably equal to or less than 32 mm, and still more preferably equal to or less than 30 mm.

As described above, FIG. 9 shows the distance S2 between the leading edge Le and the groove edge Eb. From the viewpoint of obtaining the restitution performance due to the deformation of the groove 20, it is not preferable that S2 is too small or too large. From the viewpoint of the restitution performance, the distance S2 is preferably equal to or greater than 16 mm, more preferably equal to or greater than 20 mm, and still more preferably equal to or greater than 22 mm. From the viewpoint of the restitution performance, the distance S2 is preferably equal to or less than 45 mm, more preferably equal to or less than 42 mm, and still more preferably equal to or less than 40 mm.

From the viewpoint of the deformation property of the groove 20, the thickness of the sole in the groove 20 is preferably equal to or less than 1.4 mm, more preferably equal to or less than 1.3 mm, and still more preferably equal to or less than 1.2 mm. From the viewpoint of the strength, the thickness of the sole in the groove 20 is preferably equal to or greater than 0.5 mm, more preferably equal to or greater than 0.7 mm, and still more preferably equal to or greater than 1.0 mm.

From the viewpoints of increasing the launch angle and decreasing the backspin, the height of the center of gravity of the head is preferably equal to or less than 28 mm, more preferably equal to or less than 27.5 mm, and still more preferably equal to or less than 27 mm if a head in which the height H1 (mm) of the face center Fc from the horizontal plane HP in the up-down direction is 27 mm is exemplified, for example. From the viewpoint of maintaining the moderate backspin of the hit ball, the height of the center of gravity of the head is preferably equal to or greater than 22 mm, more preferably equal to or greater than 22.5 mm, and still more preferably equal to or greater than 23 mm. Thus, the preferable range of the height of the center of gravity of the head is set for the height H1. The height of the center of gravity of the head is preferably equal to or less than (H1+1) mm, more preferably equal to or less than (H1+0.5) mm, and still more preferably equal to or less than H1 mm. The height of the center of gravity of the head is preferably equal to or greater than (H1−5) mm, more preferably equal to or greater than (H1−4.5) mm, and still more preferably equal to or greater than (H1−4) mm.

The material of the sole 6 is not limited. Examples of the material of the sole 6 include a metal and CFRP (carbon fiber reinforced plastic). Examples of the metal include one or more kinds selected from soft iron, pure titanium, a titanium alloy, stainless steel, maraging steel, an aluminium alloy, a magnesium alloy, and a tungsten-nickel alloy. Examples of the stainless steel include SUS630 and SUS304. Examples of the titanium alloy include 6-4 titanium (Ti-6Al-4V), Ti-15V-30r-3Sn-3Al, and Ti-6-22-22S. The soft iron means low carbon steel having a carbon content of less than 0.3 wt %. From the viewpoint of the restitution performance due to the deformation of the groove depth D, a titanium alloy enabling thinning is preferable.

A preferable example of the head is a driver head. The driver means a number 1 wood (W#1). Since the driver includes a particularly large sole 6, the present disclosure is preferably applied. Usually, the driver head has the following constitutions:

(1a) curved face surface (face surface including a face bulge and a face roll);

(1b) hollow part;

(1c) volume of 300 cc or greater but 460 cc or less; and (1d) real loft of 7 degrees or greater but 14 degrees or less.

Another preferable example of the head is a fairway wood head. Examples of the fairway wood include a number 3 wood (W#3), a number 4 wood (W#4), a number 5 wood (W#5), a number 7 wood (W#7), a number 9 wood (W#9), a number 11 wood (W#11), and a number 13 wood (W#13). Usually, the fairway wood head has the following constitutions:

(2a) curved face surface (face surface including a face bulge and a face roll);

(2b) hollow part;

(2c) volume of 100 cc or greater but less than 300 cc; and (2d) real loft of greater than 14 degrees but 33 degrees or less.

More preferably, the volume of the fairway wood head is 100 cc or greater but 200 cc or less.

Still another preferable example of the head is a utility type head (hybrid type head). Usually, the utility type head (hybrid type head) has the following constitutions:

(3a) curved face surface (face surface including a face bulge and a face roll);

(3b) hollow part;

(3c) volume of 100 cc or greater but 200 cc or less; and (3d) real loft of 15 degrees or greater but 33 degrees or less.

More preferably, the volume of the utility type head (hybrid type head) is 100 cc or greater but 150 cc or less.

The present disclosure can be preferably used also for an iron head having a hollow structure. The present disclosure can be preferably used also for a putter head having a hollow structure.

The present disclosure can be applied to all hollow golf club heads such as wood type, utility type, hybrid type, iron type, and putter type hollow golf club heads.

The above description is only illustrative and various changes can be made without departing from the scope of the present disclosure.

What is claimed is:

1. A hollow golf club head comprising:

a face; and a sole, wherein:

the face has a face center;

the sole includes a groove extending from a toe side to a heel side;

the whole groove is located below the face center;

a bottom part of the groove is curved so that it projects to a lower side along a shape of the sole; and a maximum value of a groove depth of the groove is 5% or greater but 15% or less of a height of a center of gravity of the head.

2. The golf club head according to claim 1, wherein the maximum value of the groove depth is equal to or less than 10% of the height of the center of gravity of the head.

3. The golf club head according to claim 1, wherein the golf club head satisfies the following item (x), (y), or (z):

(x) the groove depth is gradually decreased as the groove depth approaches a toe end in a toe side end part of the groove, and the groove depth becomes zero in the toe end;

(y) the groove depth is gradually decreased as the groove depth approaches a heel end in a heel side end part of the groove, and the groove depth becomes zero in the heel end;

(z) the groove depth is gradually decreased as the groove depth approaches the toe end in the toe side end part of the groove, and the groove depth becomes zero in the toe end; and the groove depth is gradually decreased as the groove depth approaches the heel end in the heel side end part of the groove, and the groove depth becomes zero in the heel end.

4. The golf club head according to claim 1, wherein the maximum value of the groove depth is 0.8 mm or greater but 3.2 mm or less.

5. The golf club head according to claim 4, wherein the maximum value of the groove depth is equal to or less than 2.7 mm.

6. The golf club head according to claim 4, wherein the maximum value of the groove depth is equal to or less than 2.2 mm.

7. The golf club head according to claim 1, wherein:

the groove includes a center groove part, a toe groove part located on the toe side with respect to the center groove part, and a heel groove part located on the heel side with respect to the center groove part; and the golf club head satisfies the following item (a), (b), or (c):

(a) a groove depth of the center groove part is smaller than a groove depth of the toe groove part;

(b) the groove depth of the center groove part is smaller than a groove depth of the heel groove part;

(c) the groove depth of the center groove part is smaller than the groove depth of the toe groove part, and the groove depth of the center groove part is smaller than the groove depth of the heel groove part.

8. The golf club head according to claim 1, wherein if a toe-heel direction length of the groove is defined as Lm, and a toe-heel direction width of the head is defined as Lh, Lm/Lh is 0.7 or greater but 0.92 or less.

9. The golf club head according to claim 1, wherein the golf club head satisfies the following item (z):

(z) the groove depth is gradually decreased as the groove depth approaches a toe end in a toe side end part of the groove, and the groove depth becomes zero in the toe end; and the groove depth is gradually decreased as the groove depth approaches a heel end in a heel side end part of the groove, and the groove depth becomes zero in the heel end.

10. The golf club head according to claim 1, wherein the groove depth is equal to or less than 5 mm at all positions in a toe-heel direction.

11. The golf club head according to claim 1, wherein a sole thickness in the groove is 0.5 mm or greater but 1.4 mm or less.

12. The golf club head according to claim 1, wherein if a height of the face center from a horizontal plane is defined as H1 (mm), the height of the center of gravity of the head is (H1−5) mm or greater but (H1+1) mm or less.

* * * * *